US006815130B2

(12) United States Patent
Eberlein et al.

(10) Patent No.: US 6,815,130 B2
(45) Date of Patent: Nov. 9, 2004

(54) ELECTROSTATIC PRINTING PLATE POSSESSING A TIERED SURFACE

(75) Inventors: Dietmar C. Eberlein, Wappinger Falls, NY (US); Robert H. Detig, New Providence, NJ (US)

(73) Assignee: Electrox Corporation, New Providence, NJ (US)

( * ) Notice: Subject to any disclaimer, the term of this patent is extended or adjusted under 35 U.S.C. 154(b) by 66 days.

(21) Appl. No.: 10/240,371

(22) PCT Filed: Feb. 8, 2002

(86) PCT No.: PCT/US02/04675

§ 371 (c)(1),
(2), (4) Date: Sep. 27, 2002

(87) PCT Pub. No.: WO02/063397

PCT Pub. Date: Aug. 15, 2002

(65) Prior Publication Data

US 2003/0170553 A1 Sep. 11, 2003

Related U.S. Application Data

(60) Provisional application No. 60/267,148, filed on Feb. 8, 2001.

(51) Int. Cl.[7] ..... G03G 13/32; B41L 1/00

(52) U.S. Cl. ..... 430/49; 430/124; 101/131; 101/489

(58) Field of Search ..... 430/49, 124; 101/489, 101/131

(56) References Cited

U.S. PATENT DOCUMENTS 3,561,358 A * 2/1971 Weigl ..... 430/49
3,801,315 A * 4/1974 Gundlach et al. ..... 430/49
5,891,598 A * 4/1999 Miyabe et al. ..... 430/49

* cited by examiner

*Primary Examiner*—John L Goodrow
(74) *Attorney, Agent, or Firm*—Synnestvedt Lechner & Woodbridge LLP; Stuart H. Nissim, Esq.; Roy Rosser

(57) ABSTRACT

A method and apparatus for the electrostatic printing of dry or wet toners using a novel tiered printing plate allows for superior and efficient transfer of toner from the plate to the printed item. The process for producing the printing plate uses photo polymer film resist with a positive photo tool which after developing yields trenches between ridges of hardened photo polymer which hold the toner in desired pattern.

11 Claims, 9 Drawing Sheets

ELECTROSTATIC PRINTING PLATE POSSESSING A TIERED SURFACE

CROSS REFERENCE TO RELATED APPLICATIONS

This application claims the priority of U.S. Provisional Patent Application Ser. No. 60/267,148 filed Feb. 8, 2001, the entire contents and subject matter of which is hereby incorporated in total by reference.

BACKGROUND OF THE INVENTION

1. Field of the Invention

The invention relates to improvements in electrostatic printing, more particularly to electrostatic printing plates with a tiered surface which yields superior results in part by providing a mechanical spacing between toner layer and receiving surfaces.

2. Description of the Related Art

The modern electrostatic printing plate was first described by Reisenfeld (U.S. Pat. No. 4,732,831). These plates can be used with both liquid and dry toners; however, in practice, many likely plate materials are very soft and tacky and cannot be used with dry toner for this reason. The use of durable and non-stick overcoats on printing plates, described by Detig (U.S. Pat. Nos. 4,859,557 and 5,011,758) has allowed such plate materials to be used with dry toner.

If one is using liquid toners and/or one is printing on electrically conducting surfaces (like metal) a well defined mechanical gap between the printing plate surface and the surface to be printed must be maintained. The gap prevents the receiving surface from crushing the toner layer and deforming it mechanically; also, if a metal surface touches the printing plate the transfer voltage will cause electrical breakdown of the printing plate in areas of weak dielectric strength.

Maintaining these "well-defined" mechanical gaps using current printing methods is not simple and in some cases impossible. When attempting to print onto "flat" glass it is found that such materials have both short range and long range thickness and flatness variations, which complicates the maintenance of the required mechanical gaps. In addition, the use of elastomeric toner transfer rollers to solve such problems causes placement errors in the transfer image, which are not tolerable in the manufacture of high-resolution objects, such as flat panel display, screens. The overlay accuracy between one layer and the next layer beneath it is lost.

In any large apparatus, like a cylindrical printing drum impinging on a rigid non-flat surface like glass or a metal plate; there is no true mechanical contact between the two objects except for a few high spots. This is the reason that gap transfer of toner is an important technology.

The transfer of liquid toners across mechanical gaps was described by Bujese of Olin Hunt in the patent literature. In these teachings the printing surface, either an electrostatic printing plate or photo receptor plate like in a laser printer; the mechanical gap between plate and receiving surface must be maintained by external means. This is often difficult to accomplish as the dimensions of the drum and plate approach the order of ½ to 1 meter or larger.

The present invention addresses and overcomes the problem of current printing methods by providing the required mechanical gaps via a tiered printing plate which maintains the mechanical gap even on uneven surfaces while still retaining the ability to precisely locate the plate and the printed image.

SUMMARY OF THE INVENTION

A method and apparatus for the electrostatic printing of toner on a receiving object, is comprised of the steps of applying an electrical charge to a tiered printing plate having a pattern of trenches; developing the charged, tiered printing plate with toner, thereby depositing toner in said trenches of said printing plate; placing the toner developed printing plate in proximate contact with the receiving object; applying a charge to said receiving object, and thereby transferring said toner to said receiving object; removing said printing plate from said receiving object; and removing the charge from said receiving object.

Preferred tiered printing plates are prepared by coating an electrically conductive substrate with a photo polymer; developing said photo polymer by exposing said polymer to a pattern of actinic radiation; and removing un-exposed photo polymer from said substrate, thereby forming a pattern of trenches of un-coated substrate between a pattern of developed photo polymer.

DESCRIPTION OF PREFERRED EMBODIMENTS

Figure 1:
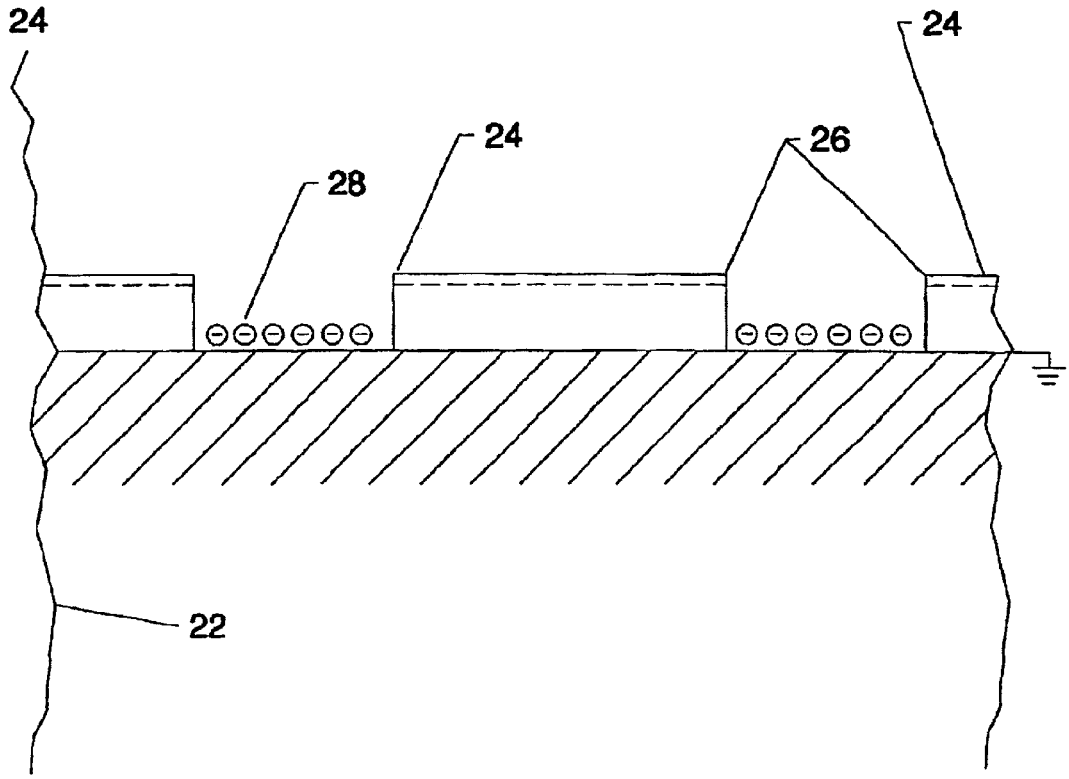
FIG. 1 illustrates the simplest configuration aspect of the invention.

One embodiment of a tiered printing plate of the invention is show in FIG. 1. The plate has an electrically conductive substrate, 22 that is coated with a charge retention layer 24. The charge retention later is capable of retaining an electrical charge and is able to be "machined" into a pattern by selectively removing portions of the charge retention layer thus forming a pattern of exposed substrate, i.e., trenches are formed between un-removed charge retention layer. The composition of the charge retention layer is selected depending upon the method of "machining" to be used and the desired thickness of the charge retention layer, i.e., depth of the "trenches". Examples of suitable substrates include, ITO coated PET film such as Neo Vac #NV-CT-250-M453-5, Santa Rosa, Calif., and titanium sputtered PEN; 300 gauge 1020 Kaladex™ (DuPont) from C P Films, Martinsville, Va. Various "machining" methods include for example, chemical etching, photolithography, and laser etching. Charge retention layers suitable for laser etching include, for example, PEN, PET and polyimides. Examples of suitable photo polymer include, Laminar 5038 dry film and Dynamask 5040 solder mask, both from Morton Electronic Materials, Tustin, Calif.

When using a photo polymer for the charge retention layer, the photo polymer is exposed in a desired pattern through a "positive" photo tool. The photopolymer is then developed to remove unneeded material. Exposed region 24 hardens or cross-links during the light exposure and is therefore not removed during the development step, leaving a pattern of photo polymer separated by trenches 25 of exposed substrate.

Substrate 22 is electrically grounded, then charged with a sensitizing charge with a suitable device known in the art, for example a Corotorn. The charge retention layer, for example, hardened photo polymer, 24 stores charge while the exposed substrate cannot charge up. The result is a good "reversal" image that is toned by a liquid or dry toner, 28; which is signed the same as that of the sensitizing charge. Suitable toners include, for example, Indigo Eprint black; (Indigo America, Woburn, Mass.) and PARMOD® E-43 silver (Parelec LLC, Rocky Hill, N.J.).

Figure 2:
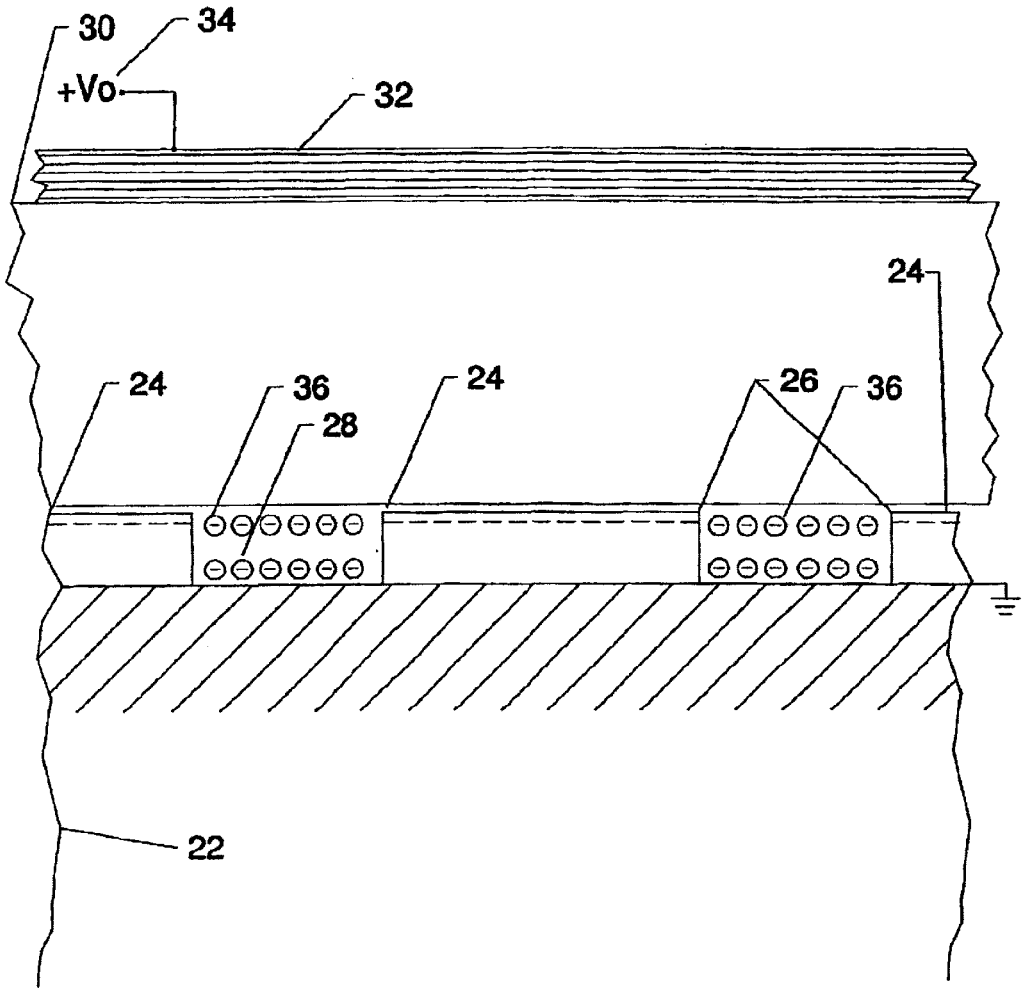
FIG. 2 illustrates the plate of FIG. 1 used to transfer toner to a rigid, non-flat glass surface.

FIG. 2 illustrates a printing method using a tiered printing plate. A receiving object 30, for example, a piece of glass, is brought into contact with the tiered printing plate. An electrode 32 on the other side of the glass is excited by voltage 34, which causes toner particles 36 to transfer from within the trenches 25 to the glass receiving object 30. Voltage Vo is retained on electrode 32 until the plate and receiving glass are separated, otherwise toner 36 would "back transfer" to the plate.

Figure 3:
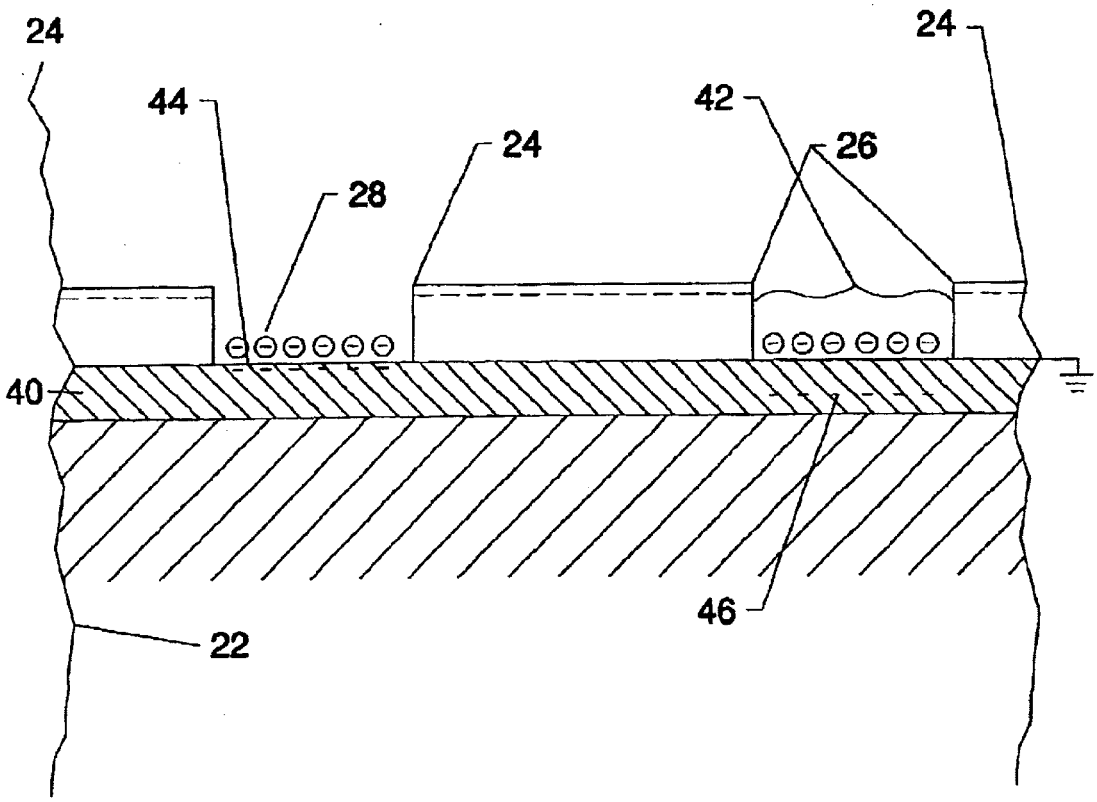
FIG. 3 illustrates a two-layer plate aspect of the invention.

FIG. 3 shows a preferred embodiment of a tiered printing plate. Whereas in FIG. 1, the substrate is conductive to establish an electrical ground plane the presence of this open conductivity area 42 may draw down the voltage levels on plate material 26 adjacent to it, especially with corona charging techniques. This means some toner will develop on the edges of the trenches as well as in the trenches 25. This could result in image broadening and toner smear. Reducing the development threshold can eliminate this at the expense of the overall amount of the toner in the trenches. In some simple systems this might be satisfactory. FIG. 3 solves these difficulties.

Grounded substrate 22 is coated with leaky insulator layer 40 and then the charge retention layer is applied and "machined" with the desired pattern, for example, a photo polymer is coated, exposed and developed, as before. Both the charge retention layer 24 and insulating layer 40 are charged up together but not necessarily to the same voltage as they are of different physical thickness. Initially charges on the leaky insulator 44 prevent voltage "drop" on the edges of charge retention layer 24. After a suitable time delay, charges 44 decay to a lower value as in 46, and eventually to a negligible level.

Figure 4:
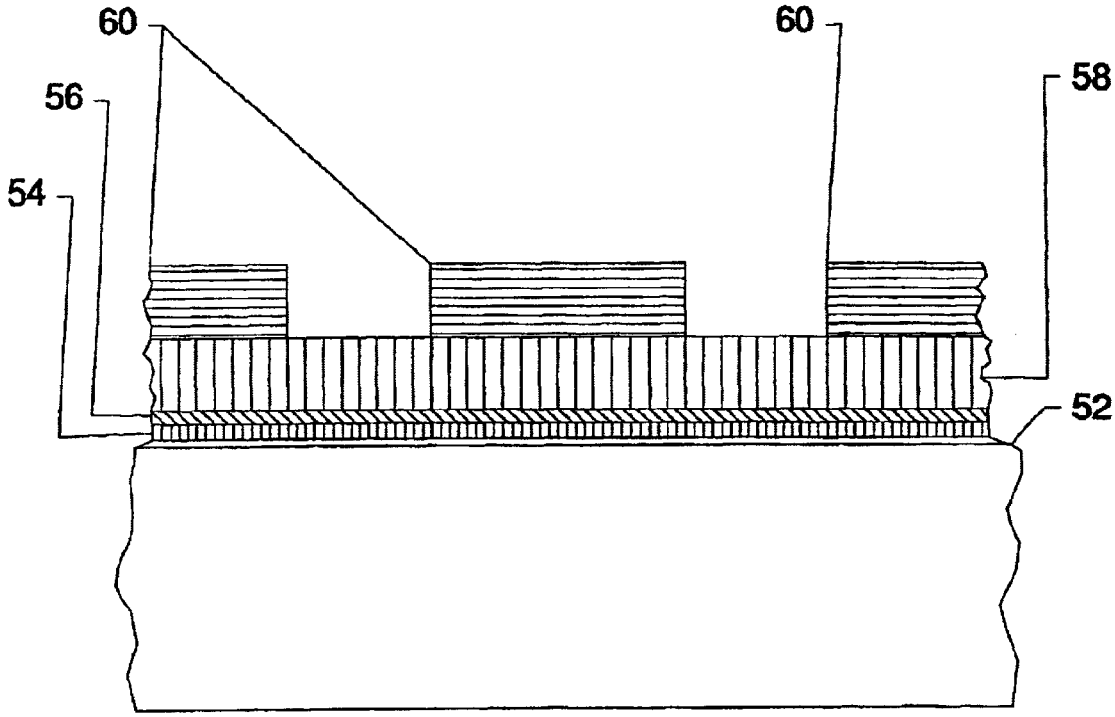
FIG. 4 illustrate an embodiment of the two-layered plate of FIG. 3.

Another preferred embodiment uses an organic photo conductor structure to help direct the placement of the charge on the tiered printing plate. As illustrated in FIG. 4, a substrate 50 is coated with thin electrical layer 52, preferably a metal, more preferably aluminum, to establish an electrical ground plane. A typical organic photo conductor structure (OPC), know in the electrophotographic industry, is established on top of this ground plane. This structure is comprised of three layers:

a. an electrical blocking layer 54 to prevent electrical carriers from the aluminum layer from injecting into the OPC structure;

b. a photo sensitive charge generation layer 56 which absorbs light and generates charge carrier pours, holes and electrons;

c. a charge transport layer, 58.

Examples of OPC plates include Super Blue, OPC Green, and Ekta Print (all commercially available from Photo Kon Inc., Fairport, N.Y.).

On top of the OPC structure is applied the photo polymer electrostatic printing plate material, 60. The photo polymer is patterned as before with a positive photo tool then developed by normal means to yield image trenches in the hardened and cross-linked background regions of the plate.

Figure 5:
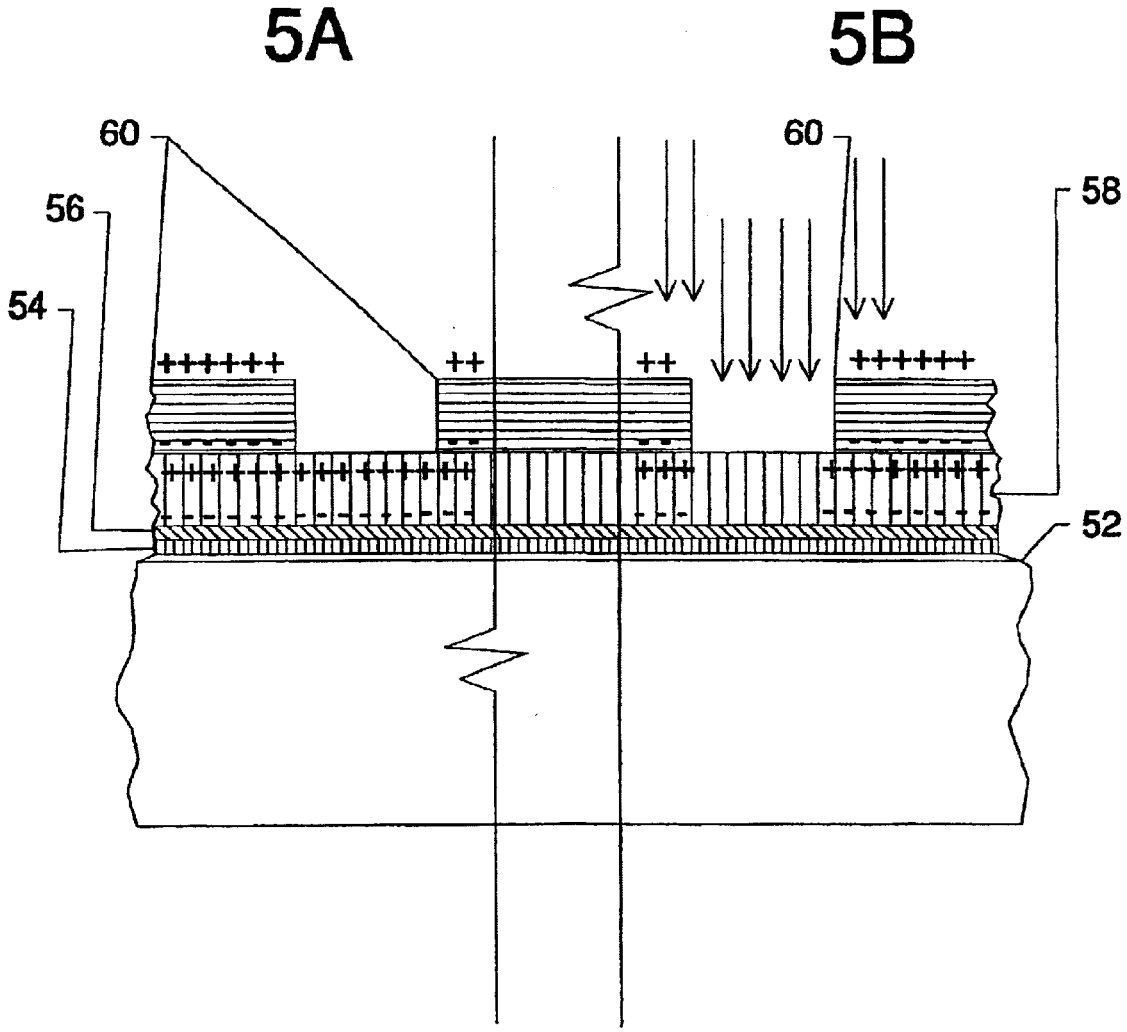
FIG. 5 illustrates a light exposure discharge step of a method of the invention utilizing the plate of FIG. 3.

FIG. 5*a* on the left shows the charge configuration when the plate of FIG. 4 is charged while in the dark. If the thickness of the printing plate material 60 is equal to that of the OPC material and they have equal dielectric constants, the total voltage across the combination of the two will divide equally. In the next step the entire plate is illuminated with red light.

Now the charges across the exposed OPC layer in the trenches will discharge due to the light exposure. The photo polymer plate material 60 is blue in color which means that it will not pass red light so the OPC under it, which is primarily sensitive to the red and near IR spectrum will not discharge.

As a result of this phenomenon, all of the charge across the plate material is preserved for toner development while a negligible amount of charges remain in the trenches. This results in maximum efficiency of toner development in the trenches.

This embodiment of the invention is to be distinguished from the over coated plates of Detig, as mentioned before and the over coated cadmium sulfide photo sensitive of the Canon NP or Katsuragawa EP processes (U.S. Pat. Nos. 3,615,395 and 3,457,070 respectively). They disclose the use of PET dielectric over layers on a photo sensitive under layer. As disclosed, the top layer was un-patterned physically and images on the photo sensitive under layer were created optically through the clear top layer. In the present invention the top layer is physically patterned or "trenched" and ideally it is an optical filter of radiation, preferably opaque.

Figure 6:
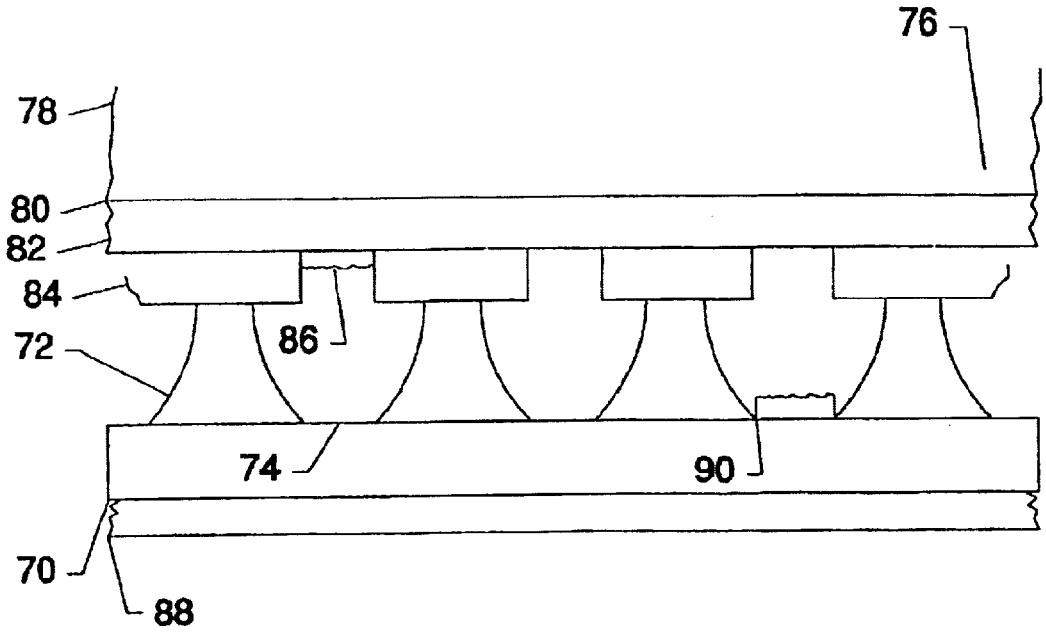
FIG. 6 illustrates a printing apparatus of the invention.

The novel tiered printing plates can be used in a variety of methods and apparatus for electrostatic printing. FIG. 6 illustrates an embodiment of the techniques of the invention as used in a manufacturing process. The receiving object 70 is a ribbed glass panel used for the back plate of a plasma display panel. The ribs 72 are typically 100 to 125 microns high and 20 to 40 microns wide. The desired goal is to print metal conductors at the bottom if the trenches 74 and phosphor toner on the bottom and side walls of the trenches. The printing can be made from a plate spaced away from the ribs. In this embodiment, the tiered printing plate is configured on a flexible substrate which is held in contact with the top surfaces of the ribs A flexible printing plate 76 consists of substrate 78 with ground plane coating 80. An OPC layer 82 is formal on the ground plane 80. Photo polymer printing plate material 84 is laminated to the OPC layer 82 and exposed and developed. The patterned printing plate 76 is now charged with a corona unit, then developed with a toner 86.

The flexible plate 76 is brought into contact with the ribbed substrate which is pre-wetted with the toner diluent material such as, Isopar™ or Isopar L™ (Exxon). An elastomeric roller gently presses the flexible plate against the ribs squeezing out excess diluent material. During this time an anti-transfer electric field is applied between the substrate of the printing plate and the electrode 88 behind the glass. This holds the toner in place on the plate during this set up procedure.

Now the transfer field is reversed causing transfer of the toner from the trenches in the plate to the trenches 90 in the glass. This transfer field is maintained while the printing plate is removed from the ribbed glass. With the toner held at the bottom of the trenches there is very little turbulence, if any, and so the toner remains in the intended places.

Figure 7:
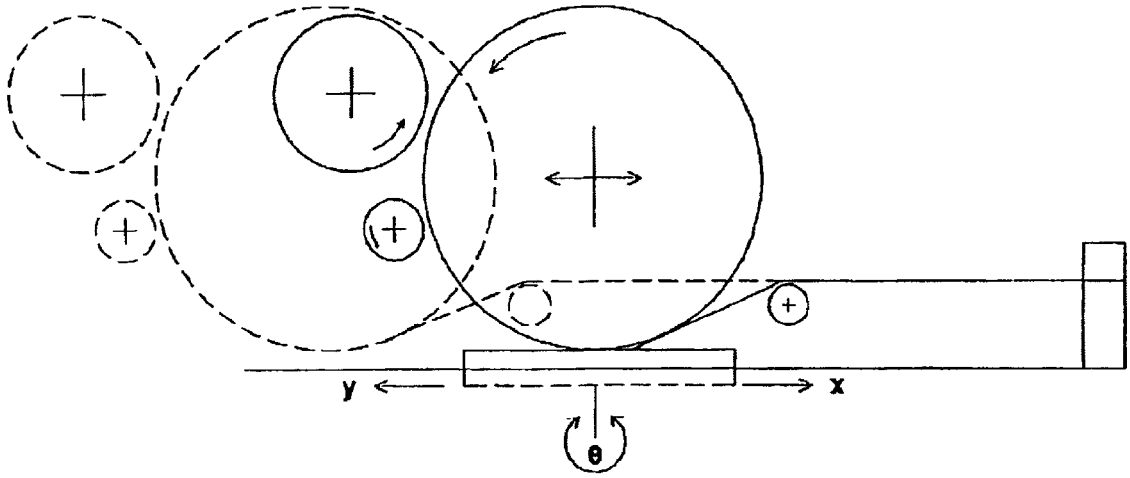
FIG. 7 illustrates an alternate apparatus of the invention.

An automated production machine of the present invention is illustrated in FIG. 7. Printing plate 94 is wrapped around drum 96 which is assembled with developer roll 100 and reverse roller 102. Printing plate 94 is sensitized with a standard corona unit (not shown) and developed by a pool of liquid toner (not shown) in the nip between drum 96 and developer roll 100. Receiving glass substrate 104 is initially to the left on chuck 106, which moves to the right as plate 94 unrolls from drum 96. Plate 94 is rolled onto the glass receiving substrate 104 as the drum assembly (96, 100,102) moves left as substrate 104 on chuck 106 moves right. The plate 94 touches the surface of substrate 104 while toner in the trenches of the plate 94 are transferred to substrate 104 by a voltage (not shown) applied to chuck 106.

After the process is completed, plate 94 is cleaned (by means not shown) and discharged; ready for the next manufacturing cycle.

Figure 8:
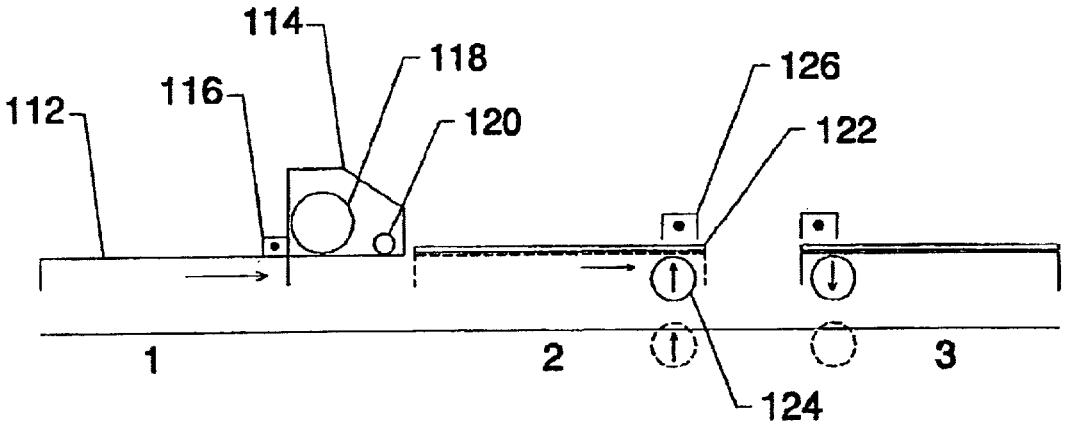
FIG. 8 illustrates another alternate apparatus of the invention.

FIG. 8 shows an alternate embodiment of an automatic machine of the invention. On the left in FIG. 8-1 is silk-screen from 110 with the printing plate 112 on the top side. Processor unit 114 contains charging unit 116, developer roll 118 and reverse condition roll 120. This processor unit moves from right to left and charges and develops the plate 112, making it ready for the transfer step.

In FIG. 8-2, processor unit 114 is not shown having moved off to the left. The glass plate to be imaged 122 is brought into close proximity to toned plate 112. It is supported by suitable means (not shown). Deflecting roller 124 is raised to deflect the screen into contact with plate 122. Simultaneously corona unit 126 charges the opposite side of glass plate 122 causing toner in the trenches of plate 112 to transfer to the glass. The deflecting roll 124 and corona unit 126 move in unison from the right to the left. FIG. 8-3 shows deflecting roll 124 and corona unit 126 in their final position.

Figure 9:
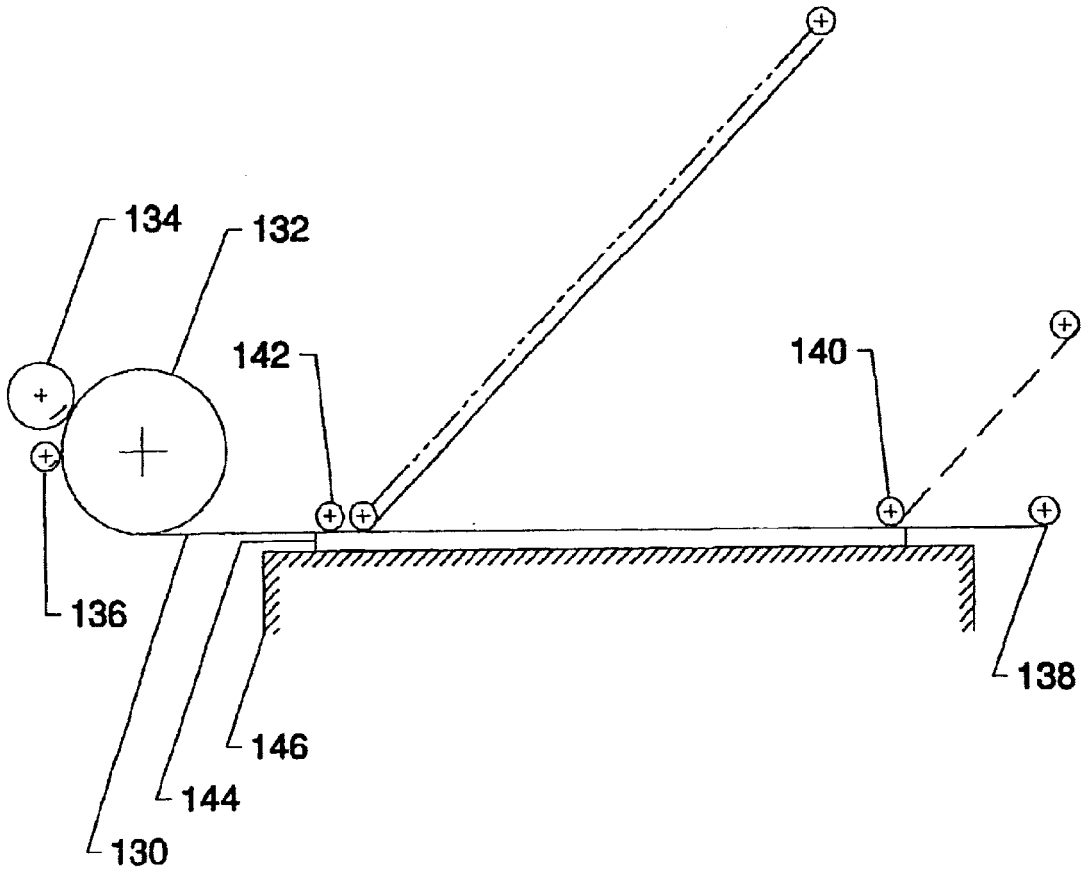
FIG. 9 shows an alternate embodiment of the invention in an automatic production machine.

FIG. 9 shows an alternate embodiment of the invention in an automatic production machine. Flexible printing plate 130 wraps around drum 132 and is anchored by roller 138. Processor unit consisting of printing plate 130 wrapped around drum 132 and developer roller 134 and reverse roller 136 moves from right to left. As plate 130 is unwrapped from drum 132 it is charged by a corona unit, (not shown) and developed by liquid toner in the nip between developer roll 134 and drum 132. A toner fountain (not shown) sprays toner into this nip. Excess liquid is removed from plate 130 by reverse roller 136. As the processor unit is moved from right to left, plate 130 is pressed into contact with glass 144 resting on chuck 146. Placement rollers 140 and 142 hold the plate firmly against the glass near its edges. During the time when the processor unit is moving, the voltage on chuck 146 is maintained in such a way as to prevent transfer of toner from the trenches of plate 130. Once placement rollers 140 and 142 are on the right and left edges respectively, of the glass 144, as shown, motion of the processor unit (132 and 136) ceases. Now the voltage on the chuck is changed to affect transfer of toner from the trenches of plate 130 to the glass.

Now the plate 130 is separated from the glass. Holding roll 138 starts upward in an arc to the left as placement roll 140 moves to the left until it just meets the other placement roll 142 at which point they move to the left together.

The toner is dried on the glass by warm air (drying means not shown) and then the glass is removed from the chuck.

The invention can be further illustrated by the following examples. These examples are provided for illustration purposes and are not limiting of the scope of the invention.

EXAMPLE 1

An electrostatic printing plate was prepared by laminating Morton 5038 dry film etch resist (Morton DynaChem; Tustin, Calif.) to the Indium Tin Oxide (ITO) coated side of a PET film, 125 microns thick. (CPF Films of Cal, part #OC-300/50). The plate was exposed through a positive photo tool at a level of 50–60 millijoules per cm $^2$.

The film etch resist was developed by ordinary mildly caustic solution removing the unexposed image areas and thereby creating trenches in the plate down to the level of the ITO layer. The plate was given an additional rinse in ½% acetic acid solution to neutralize caustic residue in the body of the hardened photo-polymer, and then washed with DI water. After drying it is further exposed to a flood of radiation in the 300 to 400 nm range at a level of 250 to 300 mj/cm2 to stabilize the electrical properties of the hardened photo polymer.

On the edge of the plate the ITO layer is connected to electrical ground by means of copper foil tape. The image was charged by means of a corona unit to approximately 900 volts.

It was then developed in the reversal mode with Indigo E-1000 magenta toner (Indigo of America, Woburn, Mass.), at 125% concentration, conductivity of 2.5 pico siemens/cm). This toner has a negative charge on the particles.

The developed plate was placed on the top of a ribbed plasma display back plate. The trenches of the printing plate and the plasma back panel plate were filled with diluent, Isopar G so no air bubbles are formed.

Pos. 3000 volts is applied to the back of the glass plate with respect to the ITO ground. The magenta toner. cleanly transferred to the bottom of the trenches. The line images on the printing plate had been carefully aligned and centered with respect to the glass rib plasma back plate.

EXAMPLE 2

50 microns thick stainless steel foil #304 of alloy, was laminated on both sides with MacDermid MP-215 etch resist (MacDermid, Waterbery, Conn.). One side was exposed with a positive photo tool to actinic radiation. The other side is exposed fully with no photo masking of the actinic light. Both sides are developed by normally mildly caustic developer yielding image trenches on the photo tool side. This laminated foil plate was mounted in a stencil frame by ordinary means, trenched side down. The exposed MP-215 on the bottom of the frame is charged with a corona unit, and the trenches of the plate are developed by ordinary means in the reversal mode using Indigo black toner at 1.25% concentration at 25 pico siemens per cm. Since this toner has a negative charge on the particles, the trenched printing plate was charged negatively.

Good toner images in the trenches were produced. These images were transferred to an anti static coated PET film (Arkwright Corp. of Fiskeville, R.I. TX-703). This is a commercially available transparency film for copiers and laser printers.

EXAMPLE 3

An OPC imaging belt from an Indigo of America E print 1000 (Woburn, Mass.) which is an approximate 25 micron thick OPC structure on 125 micron thick Aluminized PET film; was laminated with Morton 5038 dry film etch resist. Using a positive photo tool the Morton film was exposed to actinic radiation at a standard level of 50 to 60 millijoules per cm. It was developed by ordinary means with a post development cure in mild acetic acid and post flood exposure at 5 to 6 times normal exposure.

It was charged in the dark with a negative corona unit to approximately 1200 volts total. Upon turning on the room lights in the lab, the voltage drops to the −750 to −775 v level. It was developed with ⅓% Indigo black toner at a conductivity of 25 pico siemens per cm. A layer of Arkwright TX-703 transparency film was overlaid on the plate with care to avoid air bubbles. The back of the film was corona charged with a positive corona unit and the film lifted from the plate. High quality images were observed on the film.

EXAMPLE 4

In this example Dyna Chem 5038 etch resist was laminated to OPC plate material #L-06152 produced by AEG Electrofotografie GmbH of Warstein, Germany. It was exposed, developed and given a final finished in a manner identical to Example 3.

It was charged, toned and images transferred to both Arkwright TX-703 transparency film and 0.5 mm thick Electroverre glass, EVR (Erie Scientific, Portsmouth, N.H.). Transfers were accomplished by both corona charging the reverse side on the glass and with an electrode connected to a high voltage. With the 0.5 mm thick EVR glass, a transfer voltage of +2500 volts was required for 1.25% Indigo toner. Excellent transfer resulted.

EXAMPLE 5

Plates were prepared and used in an identical manner to Example 4—except that AEG L-06171 OPC plate material was used for the substrate. Results were excellent.

EXAMPLE 6

75 micron thick polyester adhesive (PAF-130, Adhesive Films, Pine Brook, N.J.) was laminated to ITO coated PET (Neo Vac, Santa Rosa, Calif., 125 microns thick, 250 ohm/sq) as the substrate. Type HN Kapton™ 125 micron thick is laser machined by Potomac Photonics, Landham, Md. to the pattern to be imaged. This laser machined Kapton layer was then heat laminated to the polyester/ITO-PET substrate.

What is claimed is:

1. An electrostatic printing apparatus having a printing plate which is comprised of a trenched printing plate having a patterned coating of a charge retention layer, said charge retention layer being sufficiently thick to maintain a gap between toner attached within said trenches and a surface to be printed, when said surface to be printed is in contact with said charge retention layer.

2. The apparatus of claim 1, whereby the pattern of the charge retention layer forms a corresponding and opposite pattern of exposed substrate.

3. The apparatus of claim 1 wherein said substrate is electrically conductive.

4. The apparatus of claim 1 wherein said charge retention layer is selected from the group consisting of developed photo polymer, PEN, PET and polyimide.

5. The apparatus of claim 1 wherein said substrate is comprised of a base substrate having an electrically conductive layer and an organic photo conductor layer.

6. The apparatus of claim 5 wherein said organic photo conductor layer is comprised of an electrical blocking layer, a photo sensitive charge generation layer, and a charge transport layer.

7. A method for preparing a trenched electrostatic printing plate comprising the steps of:

A) coating an electrically conductive substrate with a charge retention layer said charge retention layer being sufficiently thick to maintain a gap between toner attached within said trenches and a surface to be printed, when said surface to be printed is in contact with said charae retention layer; and B) forming a pattern in said charge retention layer by removing portions of said charge retention layer, thereby forming a pattern of trenches of un-coated substrate between a pattern of charge retention layer.

8. The method of claim 7 wherein said substrate is comprised of a base substrate having an electrically conductive layer and an organic photo conductor layer comprised of an electrical blocking layer, a photo sensitive charge generation layer, and a charge transport layer.

9. The method of claim 7 wherein the charge retention layer is comprised of a photo polymer and wherein the pattern forming of step B) is accomplished by developing said photo polymer by exposing said polymer to a pattern of actinic radiation and removing un-exposed photo polymer from said substrate.

10. A method for the electrostatic printing of toner on a receiving object, comprising the steps of A) applying an a sensitizing electrical charge to a trenched printing plate having a charge-retention layer patterned with charge-conducting trenches;

B) developing the charged, trenched printing plate with toner having a same signed charge as said sensitizing electrical charge, thereby depositing toner in said trenches of said printing plate;

C) placing said-charae retention layer of the toner developed printing plate in proximate contact with the receiving object, thereby maintaining a gap between the deposited toner on said charge conducting trenches and said receiving object;

D) applying a charge to said receiving object, and thereby transferring said toner to said receiving object across said gap;

E) removing said printing plate from said receiving object; and

F) removing the charge from said receiving object.

11. The method of claim 10 wherein the trenched printing plate has a layer of organic photo conductor below said trenches whereby, after step A) the printing plate is exposed to actinic radiation which removes the charge from the trenches but leaving the charge on the remainder of said printing plate.

* * * * *